US009457284B2

(12) United States Patent
Ostendorff

(10) Patent No.: US 9,457,284 B2
(45) Date of Patent: Oct. 4, 2016

(54) SPIRAL TOY TRACK SET

(71) Applicant: Eric C. Ostendorff, Torrance, CA (US)

(72) Inventor: Eric C. Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 486 days.

(21) Appl. No.: 13/895,752

(22) Filed: May 16, 2013

(65) Prior Publication Data

US 2013/0309937 A1 Nov. 21, 2013

Related U.S. Application Data

(60) Provisional application No. 61/649,564, filed on May 21, 2012.

(51) Int. Cl.

| | |
|---|---|
| ***A63H 18/00*** | (2006.01) |
| ***A63H 18/02*** | (2006.01) |
| ***A63H 18/06*** | (2006.01) |

(52) U.S. Cl.

CPC ..... *A63H 18/00* (2013.01); *A63H 18/02* (2013.01); *A63H 18/028* (2013.01); *A63H 18/06* (2013.01)

(58) Field of Classification Search

USPC ..... 446/168, 170, 171, 172, 173, 174, 429, 446/444; 273/112, 119 R, 120 R

See application file for complete search history.

(56) References Cited

U.S. PATENT DOCUMENTS

| | | | |
|---|---|---|---|
| 469,948 | A | 3/1892 | Reed |
| 806,930 | A | 12/1905 | Smith |
| 812,595 | A | 2/1906 | Roberts |
| 831,907 | A | 9/1906 | Townsend |
| 889,169 | A | 6/1908 | Brothen |
| 1,113,945 | A | 10/1914 | Bain |
| 1,116,577 | A | 11/1914 | Dugger |
| 1,209,127 | A | 12/1916 | Corey |
| 1,244,457 | A | 10/1917 | Bain |
| 1,244,702 | A | 10/1917 | Christ |
| 1,247,226 | A | 11/1917 | Cole |
| 1,252,616 | A | 1/1918 | Reif |

(Continued)

FOREIGN PATENT DOCUMENTS

| | | | |
|---|---|---|---|
| CN | 201067632 | Y | 6/2008 |
| CN | 101687116 | A | 3/2010 |

(Continued)

OTHER PUBLICATIONS

European Search Report dated Nov. 13, 2013 for Application No. 13168331.0.

(Continued)

*Primary Examiner* — Melba Bumgarner
*Assistant Examiner* — Joseph B Baldori
(74) *Attorney, Agent, or Firm* — Sheppard, Mullin, Richter & Hampton LLP

(57) ABSTRACT

A track set is disclosed herein. The track set includes a track portion configured for receiving at least one device configured to traverse within the track portion, and a rotatable track portion. The rotatable track portion includes a receiving member and a generally spiral portion. The rotatable track portion is selectively rotatable about an axis. The receiving member is positioned to selectively receive the at least one device from the track portion as the rotatable track portion rotates. Movement of the device within the spiral portion generally maintains rotation of the rotatable track portion about the axis.

13 Claims, 6 Drawing Sheets

(56) References Cited

U.S. PATENT DOCUMENTS 1,261,691 A 4/1918 Bunkley
1,279,271 A 9/1918 Cole
1,284,477 A 11/1918 Seils
1,287,450 A 12/1918 Sabina et al.
1,287,608 A 12/1918 Austin
1,295,504 A 2/1919 Howard et al.
1,301,552 A 4/1919 Gaines
1,314,238 A 8/1919 Bain
1,315,108 A 9/1919 Gaines
1,317,184 A 9/1919 Voss
RE14,902 E 6/1920 Gaines
1,347,968 A 7/1920 O'Doie
1,351,981 A 9/1920 Zipf
1,355,636 A 10/1920 Bain
1,361,449 A 12/1920 Danner
1,392,727 A 10/1921 Welsh
1,454,173 A 5/1923 Keiner
1,472,783 A 11/1923 Bauer
1,478,350 A 12/1923 Okel
RE15,900 E 8/1924 Hetzner
1,523,244 A 1/1925 Bain
1,527,006 A 2/1925 O'Reilly
1,546,377 A 7/1925 Gunderman
1,560,181 A 11/1925 Marx
1,561,633 A 11/1925 Bain
1,568,492 A 1/1926 Zabel
1,599,699 A 9/1926 Zabel
1,599,982 A 9/1926 Bauer
1,617,846 A 2/1927 Hawk
RE16,791 E 11/1927 Hawk
1,666,417 A 4/1928 Harris
1,696,532 A 12/1928 Enloe
RE17,312 E 6/1929 Beck
1,715,891 A 6/1929 Beck
1,724,447 A 8/1929 Abbott et al.
1,725,536 A 8/1929 Marx
1,739,719 A 12/1929 Gunderman
1,748,184 A 2/1930 Nichols
1,758,061 A 5/1930 Rentz et al.
1,870,586 A 8/1932 Platakis
1,872,204 A 8/1932 Wily
2,128,863 A 8/1938 Turrian
2,211,220 A 8/1940 Verplanck
2,249,728 A 7/1941 Cross
2,336,773 A 12/1943 Black et al.
2,391,529 A 12/1945 Walker
2,392,722 A 1/1946 Burlin
2,400,013 A 5/1946 Lowell et al.
2,400,410 A 5/1946 Hatcher
2,419,990 A 5/1947 Dishmaker
2,434,571 A 1/1948 Long
2,531,564 A 11/1950 Garbe
2,616,699 A 11/1952 Franks
2,634,128 A * 4/1953 Reed ..... 273/120 R
2,655,116 A 10/1953 Gowland
2,672,709 A 3/1954 Ernst
2,756,687 A 7/1956 Fields
2,785,504 A 3/1957 Kooistra, Sr.
2,838,159 A 6/1958 Siegfried
2,853,301 A 9/1958 Glass
2,998,673 A 9/1961 Rhodes
2,999,689 A 9/1961 Litwinczuk
3,251,155 A 5/1966 Bjork
3,298,692 A 1/1967 Glass et al.
3,300,891 A 1/1967 Glass et al.
3,314,169 A 4/1967 Wold
3,343,793 A 9/1967 Waser
3,401,484 A 9/1968 Anslover
3,542,366 A 11/1970 Schocker
3,548,534 A 12/1970 Beny et al.
3,570,171 A 3/1971 Shook
3,572,713 A 3/1971 Krause
3,600,849 A 8/1971 Faller
3,621,602 A 11/1971 Barcus et al.
3,633,308 A 1/1972 Yang
3,666,264 A 5/1972 Bartlett
3,703,989 A 11/1972 Tomiyama
3,708,116 A 1/1973 Woodward
3,712,538 A 1/1973 Starr et al.
3,726,476 A 4/1973 Porter et al.
3,734,404 A 5/1973 Baynes et al.
3,735,923 A 5/1973 Brigham et al.
3,795,983 A 3/1974 Gallagher et al.
3,803,756 A 4/1974 Strongin
3,818,628 A 6/1974 Ensmann et al.
3,860,238 A 1/1975 Kojima
3,908,303 A 9/1975 McKay et al.
3,986,296 A 10/1976 Hamano
4,037,355 A 7/1977 Street
4,055,913 A 11/1977 Sindelar
4,068,402 A 1/1978 Tanaka
4,091,561 A 5/1978 Kimura
4,094,089 A 6/1978 Sano
4,128,964 A 12/1978 Ogasawara
4,140,276 A 2/1979 Halford
4,146,991 A 4/1979 Sano
4,159,593 A 7/1979 Miller
4,161,279 A 7/1979 Halford
4,185,409 A 1/1980 Cheng
4,195,776 A 4/1980 Lehmann
4,203,247 A 5/1980 Moe et al.
4,219,198 A 8/1980 Meyer et al.
4,223,834 A 9/1980 Fechter
4,241,534 A 12/1980 Larsson et al.
4,249,733 A 2/1981 Eddins et al.
4,254,576 A 3/1981 Matsumoto et al.
4,267,661 A 5/1981 Hanson
4,291,488 A 9/1981 Orenstein
4,301,613 A 11/1981 Kooistra, Sr.
4,312,149 A 1/1982 Iwao
4,357,778 A 11/1982 Matsumoto et al.
4,373,693 A 2/1983 Greenberger
4,386,777 A 6/1983 Prehodka
4,394,961 A 7/1983 Muller
4,426,797 A 1/1984 Burkemper et al.
4,468,031 A 8/1984 Barlow et al.
4,475,303 A 10/1984 Ribas et al.
4,496,100 A 1/1985 Schwager et al.
4,513,966 A 4/1985 Mucaro et al.
4,519,789 A 5/1985 Halford et al.
4,557,064 A 12/1985 Thompson
4,558,867 A 12/1985 Hippely
4,564,197 A 1/1986 Lambert et al.
4,575,350 A 3/1986 Hippely et al.
RE32,106 E 4/1986 Lemelson
4,585,166 A 4/1986 Stephens
4,609,363 A 9/1986 Udagawa
4,659,320 A * 4/1987 Rich et al. ..... 446/435
4,673,308 A 6/1987 Reilly
4,678,449 A 7/1987 Udagawa
4,708,685 A 11/1987 Udagawa
4,715,843 A 12/1987 Ostendorff et al.
4,734,076 A * 3/1988 Goldstein et al. ..... 446/423
4,795,394 A 1/1989 Thompson
4,874,342 A 10/1989 Klitsner
4,909,464 A 3/1990 Levine et al.
4,928,955 A 5/1990 Chuan
4,932,917 A 6/1990 Klitsner
4,951,872 A 8/1990 Sheffield
4,961,716 A 10/1990 Hippely et al.
5,022,884 A * 6/1991 Hippely et al. ..... 446/14
5,075,515 A 12/1991 Yoneda et al.
5,078,642 A 1/1992 Glessner
5,102,133 A 4/1992 Chilton et al.
5,107,601 A 4/1992 Semchuck
5,161,104 A 11/1992 Fox et al.
5,174,569 A 12/1992 Ngai
5,254,030 A 10/1993 Ostendorff et al.
5,299,969 A 4/1994 Zaruba
5,312,285 A 5/1994 Rieber et al.
5,342,048 A 8/1994 Jones et al.
5,344,143 A 9/1994 Yule
5,370,571 A 12/1994 Bosch
5,392,987 A 2/1995 Ropers et al.

(56) References Cited

U.S. PATENT DOCUMENTS

| | | | | |
|---|---|---|---|---|
| 5,419,066 | A | 5/1995 | Harnois et al. | |
| 5,473,833 | A | 12/1995 | Ostrovsky | |
| 5,480,115 | A | 1/1996 | Haltof | |
| 5,542,668 | A * | 8/1996 | Casale et al. | 463/59 |
| 5,586,923 | A | 12/1996 | Hippely et al. | |
| 5,735,724 | A | 4/1998 | Udagawa | |
| 5,767,655 | A * | 6/1998 | Ostendorff et al. | 320/107 |
| 5,785,573 | A | 7/1998 | Rothbarth et al. | |
| 5,803,782 | A | 9/1998 | Selton | |
| 5,846,018 | A | 12/1998 | Frobosilo et al. | |
| 5,855,501 | A | 1/1999 | Kato et al. | |
| 5,899,011 | A | 5/1999 | Brinkman | |
| 5,899,789 | A * | 5/1999 | Rehkemper et al. | 446/444 |
| 5,967,052 | A | 10/1999 | Prokopf | |
| 6,000,992 | A | 12/1999 | Lambert | |
| 6,026,603 | A | 2/2000 | Kump et al. | |
| 6,056,620 | A | 5/2000 | Tobin | |
| 6,170,754 | B1 | 1/2001 | Halford | |
| 6,241,573 | B1 | 6/2001 | Ostendorff et al. | |
| 6,358,112 | B1 * | 3/2002 | Lambert et al. | 446/429 |
| 6,409,132 | B2 | 6/2002 | Heisler et al. | |
| 6,439,955 | B1 | 8/2002 | Feketo | |
| 6,478,654 | B1 * | 11/2002 | Rehkemper et al. | 446/431 |
| 6,508,179 | B2 | 1/2003 | Annis et al. | |
| 6,640,453 | B2 | 11/2003 | Eisenmenger | |
| 6,647,893 | B1 | 11/2003 | Fugitt et al. | |
| 6,676,480 | B2 | 1/2004 | Sheltman | |
| 6,766,585 | B2 | 7/2004 | Thomas | |
| 6,783,419 | B1 * | 8/2004 | Paukert et al. | 446/75 |
| 6,862,997 | B2 | 3/2005 | Bussink | |
| 6,951,307 | B2 | 10/2005 | Lin | |
| 6,951,497 | B1 | 10/2005 | Ngan | |
| 6,951,498 | B2 | 10/2005 | Rudell | |
| 6,953,377 | B2 | 10/2005 | Quercetti | |
| D511,961 | S | 11/2005 | Jordan | |
| 6,976,316 | B1 | 12/2005 | Patterson | |
| 7,066,783 | B2 | 6/2006 | Fischer | |
| 7,325,348 | B2 | 2/2008 | Mueller et al. | |
| 7,353,758 | B2 | 4/2008 | Murray | |
| 7,373,731 | B2 | 5/2008 | Nyberg | |
| 7,517,272 | B2 | 4/2009 | Bedford et al. | |
| 7,527,156 | B2 | 5/2009 | Wisnoski et al. | |
| 7,549,906 | B2 | 6/2009 | Bedford et al. | |
| 7,600,757 | B1 | 10/2009 | Matilla et al. | |
| 7,600,859 | B2 | 10/2009 | Huang et al. | |
| 7,614,931 | B2 | 11/2009 | Nuttall | |
| 7,618,302 | B2 | 11/2009 | Collins et al. | |
| 7,628,673 | B2 | 12/2009 | Bedford et al. | |
| 7,651,398 | B2 | 1/2010 | Ostendorff et al. | |
| 7,690,964 | B2 | 4/2010 | Nuttall et al. | |
| 7,708,317 | B2 | 5/2010 | Leblanc | |
| 7,766,720 | B2 | 8/2010 | Ostendorff | |
| 7,770,811 | B2 | 8/2010 | Belding | |
| 7,857,679 | B2 | 12/2010 | O'Connor et al. | |
| 8,162,716 | B2 | 4/2012 | Nuttall | |
| 8,430,712 | B2 | 4/2013 | O'Connor et al. | |
| 8,608,527 | B2 | 12/2013 | O'Connor et al. | |
| 8,690,462 | B2 | 4/2014 | Shaw et al. | |
| 8,690,632 | B2 | 4/2014 | O'Connor et al. | |
| 8,747,180 | B2 | 6/2014 | O'Connor et al. | |
| 8,814,628 | B2 * | 8/2014 | O'Connor et al. | 446/444 |
| 2003/0220044 | A1 * | 11/2003 | Andrews et al. | 446/268 |
| 2003/0224697 | A1 | 12/2003 | Sheltman et al. | |
| 2004/0078991 | A1 | 4/2004 | Thomas | |
| 2005/0287915 | A1 | 12/2005 | Sheltman et al. | |
| 2005/0287919 | A1 | 12/2005 | Sheltman et al. | |
| 2006/0027779 | A1 | 2/2006 | McGuire | |
| 2006/0277779 | A1 | 12/2006 | Bauer | |
| 2006/0286896 | A1 | 12/2006 | Bedford et al. | |
| 2006/0286897 | A1 | 12/2006 | Bedford et al. | |
| 2007/0012636 | A1 | 1/2007 | Wisnoski et al. | |
| 2007/0049160 | A1 | 3/2007 | Matthes et al. | |
| 2007/0128969 | A1 | 6/2007 | Shrock et al. | |
| 2007/0209543 | A1 | 9/2007 | Beaulieu et al. | |
| 2008/0064295 | A1 | 3/2008 | Abrams | |
| 2008/0066560 | A1 * | 3/2008 | Yu et al. | 73/861.85 |
| 2008/0070474 | A1 | 3/2008 | Nuttall | |
| 2008/0268743 | A1 | 10/2008 | O'Connor et al. | |
| 2009/0075558 | A1 | 3/2009 | Ostendorff | |
| 2010/0056015 | A1 | 3/2010 | Nuttall | |
| 2010/0112896 | A1 | 5/2010 | Chang et al. | |
| 2010/0184353 | A1 | 7/2010 | Jobe | |
| 2010/0199598 | A1 | 8/2010 | Townsend et al. | |
| 2010/0273394 | A1 | 10/2010 | O'Connor et al. | |
| 2011/0086574 | A1 | 4/2011 | Nuttall et al. | |
| 2011/0124265 | A1 | 5/2011 | O'Connor et al. | |
| 2011/0269372 | A1 | 11/2011 | Nuttall | |
| 2012/0052766 | A1 | 3/2012 | Payne | |
| 2012/0052767 | A1 * | 3/2012 | Martino et al. | 446/465 |
| 2012/0061484 | A1 | 3/2012 | Payne et al. | |
| 2012/0062766 | A1 | 3/2012 | Park | |
| 2012/0115393 | A1 | 5/2012 | Moh et al. | |
| 2012/0164914 | A1 | 6/2012 | O'Connor et al. | |
| 2012/0276808 | A1 * | 11/2012 | Nuttall et al. | 446/444 |
| 2012/0322342 | A1 | 12/2012 | De La Torre | |
| 2013/0288568 | A1 * | 10/2013 | Schmid et al. | 446/444 |
| 2014/0070015 | A1 | 3/2014 | Matthes et al. | |

FOREIGN PATENT DOCUMENTS

| | | | |
|---|---|---|---|
| DE | 440375 | C | 2/1927 |
| DE | 575170 | C | 4/1933 |
| DE | 4403361 | A1 | 8/1995 |
| GB | 2043469 | A | 10/1980 |
| JP | 07-328241 | A | 12/1995 |
| WO | 88-04191 | A1 | 6/1988 |
| WO | 2011137433 | A2 | 3/2011 |
| WO | 2012027737 | A2 | 1/2012 |
| WO | 2012027737 | A3 | 3/2012 |
| WO | 2012027753 | A2 | 3/2012 |
| WO | 2012027753 | A3 | 3/2012 |

OTHER PUBLICATIONS

European Search Report dated Nov. 5, 2013 for Application No. 13184129.8.

Partial European Search Report for Application No. 13187427.3-1658; Dated: Feb. 5, 2014.

International Search Report dated Apr. 9, 2012 for International Application No. PCT/US2011/049587.

Written Opinion dated Apr. 9, 2012 for International Application No. PCT/US2011/049587.

English Translation of Abstract CN201067632.

English Translation of Abstract CN101687116.

English Translation of Chinese Office Action for Application No. 2013101901814 dated Feb. 3, 2015.

Chinese Office Action for Application No. 2013101901814 dated Feb. 3, 2015.

* cited by examiner

SPIRAL TOY TRACK SET

CROSS REFERENCE TO RELATED APPLICATIONS

This application claims the benefit of U.S. Provisional Patent Application No. 61/649,564, filed May 21, 2012, the entire contents of which are incorporated herein by reference thereto.

BACKGROUND

Various embodiments of the present invention are related to toys, and in particular, a track set on which toy vehicles may travel.

Toy vehicle track sets have been popular for many years and generally include one or more track sections arranged to form a path around which one or more toy vehicles can travel. Toy vehicles which may be used on such track sets may be either self-powered vehicles or may receive power from an external source.

Accordingly, it is desirable to provide toy track set with features that provide unique paths for the toy vehicles of the toy track to travel on.

SUMMARY OF THE INVENTION

In one embodiment, a track set is disclosed. The track set includes a track portion configured for receiving at least one device configured to traverse within the track portion, and a rotatable track portion. The rotatable track portion includes a receiving member and a generally spiral portion. The rotatable track portion is selectively rotatable about an axis. The receiving member is positioned to selectively receive the at least one device from the track portion as the rotatable track portion rotates. Movement of the device within the spiral portion generally maintains rotation of the rotatable track portion about the axis.

In another embodiment, a track set toy is disclosed. The track set includes a track portion configured for receiving at least one device configured to traverse within the track portion, a rotatable track portion, and a diverter member. The rotatable track portion includes a receiving member, a generally spiral portion, and an exit portion. The rotatable track portion is selectively rotatable about an axis. The receiving member is positioned to receive the device from the track portion. Movement of the device within the spiral portion generally maintains rotation of the rotatable track portion about the axis. The rotatable track portion terminates at the exit portion. The diverter track portion is positioned to receive the device from the exit portion of the rotatable track portion. The track portion is configured to allow the device to exit therefrom via the exit portion to another track portion.

BRIEF DESCRIPTION OF THE DRAWINGS

Other features, advantages and details appear, by way of example only, in the following description of embodiments, the description referring to the drawings in which.

DETAILED DESCRIPTION

Figure 1:
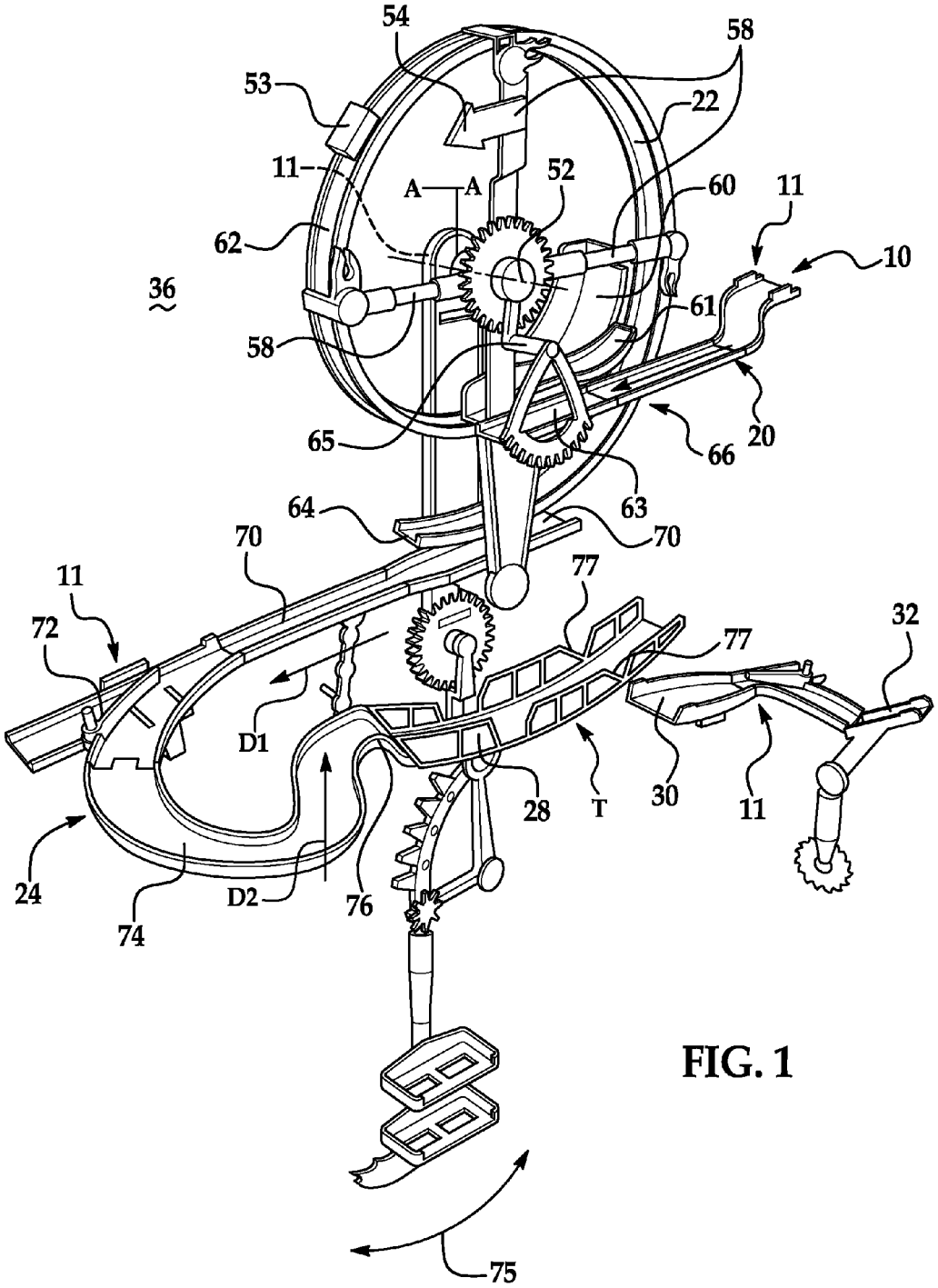
FIG. 1 is a perspective view of one non-limiting exemplary embodiment of a track set according to the present invention.

Referring now to FIG. 1, a track set 10 in accordance with an exemplary embodiment of the present invention is illustrated. In the embodiment as shown, the track set 10 includes a plurality of track segments. The track segments may include, for example, a receiving track portion or track portion or first track portion 20, a rotatable track segment or rotatable track portion 22, a linear track segment or second track portion or second track segment 70, a diverter track set 24 including a plurality of segments, a curved bridge 28, a second diverter track segment 30, and a drawbridge track segment 32. Of course, any other suitable configuration having fewer track segments or additional track segments is considered to be within the scope of exemplary embodiments of the present invention, and the track set 10 is not limited to the specific configurations illustrated herein.

In the embodiments as shown in FIGS. 1-8, the track set 10 may be mounted to a generally planar surface 36 via a plurality of wall mounts 11. In some embodiments, the track set 10 is mounted to a wall. In one embodiment, the wall mounts may be those described in commonly owned U.S. patent Ser. No. 13/220,364 filed on Aug. 29, 2011, and U.S. Provisional Patent Application Ser. Nos. 61/377,743 and filed on Aug. 27, 2010 and 61/480,793 filed on Apr. 29, 2011, the contents each of which are incorporated herein by reference thereto in their entirety. It is to be understood that although a wall is discussed, the track set 10 may be mounted to other types of surfaces, as well. While the planar surface 36 is generally mounted to a vertical surface, the track set 10 may be mounted to a surface that is oriented in other configurations as well (e.g., a generally horizontal surface such as, for example, a floor). For example, the track set may include a stand that connects to the track set and supports the track set at a particular distance above the floor.

The receiving track portion 20 may include various track segments configured for receiving at least one moveable device (shown in FIG. 2) such as, for example, a toy vehicle 50 that is configured to traverse within the receiving track portion 20. One non-limiting example of such a toy vehicle 50 is commercially available from Mattel, Inc. and sold under the trademark HOT WHEELS. Of course, any other type of toy vehicle may be utilized as well. Also, although a toy car is discussed, it is understood that any other type of moveable device or object that is configured to traverse or travel within the track segments as illustrated may be used as well. For example, the object may be a toy figurine with wheels. The receiving track portion 20 is configured for receiving a queue of toy vehicles 50.

Figure 2:
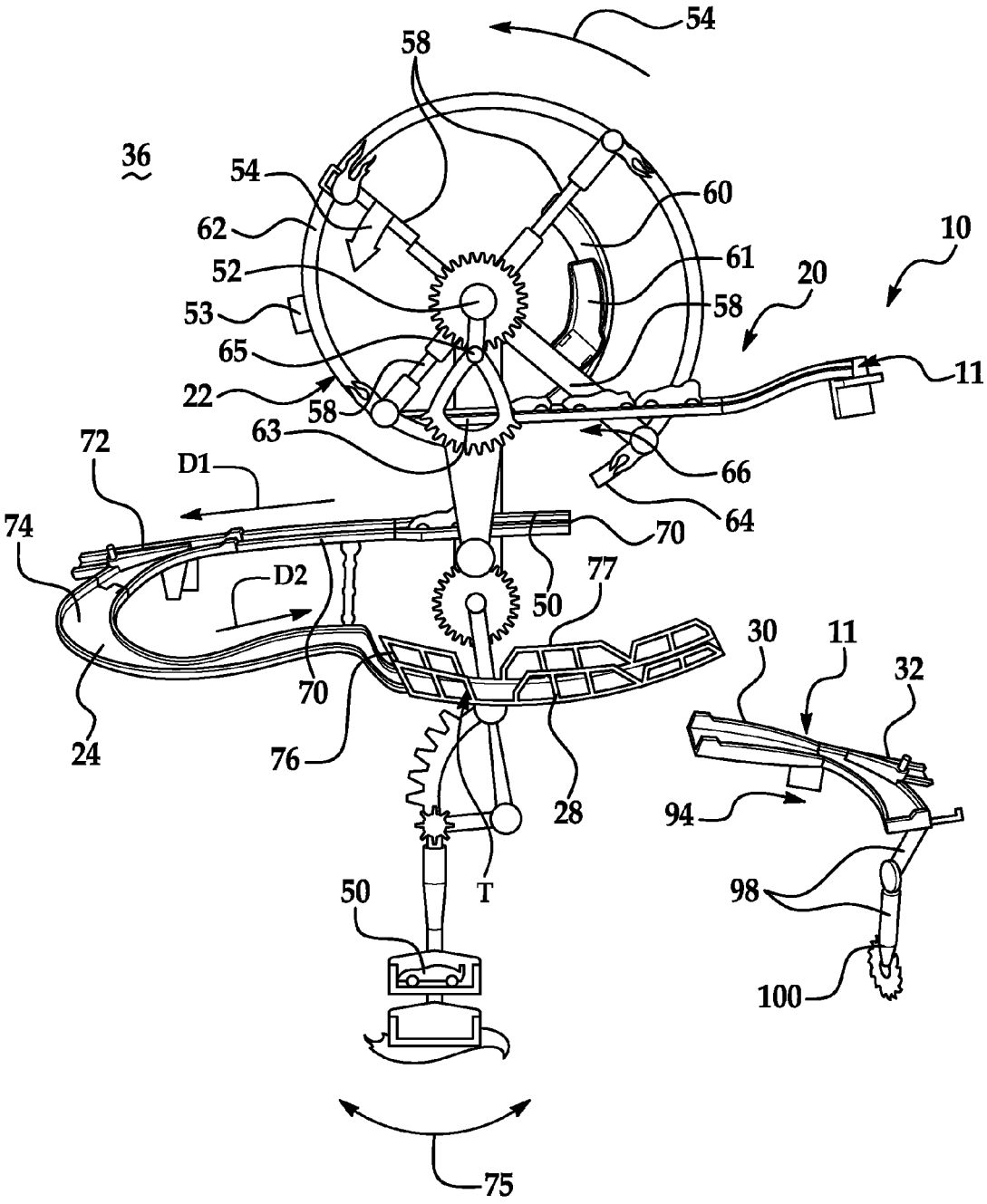
FIGS. 2-5 are front views of one non-limiting exemplary embodiment of a track set according to the present invention illustrating rotational movement of a portion of the track set.

The rotatable track segment 22 is rotatable about an axis A-A (shown in FIG. 1). The axis A-A is generally perpendicular to the generally planar surface 36. In the embodiment as shown in FIGS. 1-2, the rotatable track segment 22 is rotatable about a shaft 52 that, in this instance, defines the axis A-A. Specifically, the rotatable track segment 22 is configured to receive an initial force (e.g., a relatively light push from a user) that is oriented in a counterclockwise direction. The initial force causes the rotatable track segment 22 to rotate or spin about the shaft 52. In addition, the rotatable track segment 22 may include a weight 53 or is balanced so that rotational movement of the rotatable track segment 22 continues in the direction of arrow 54 when a toy vehicle or toy vehicles 50 is/are travelling thereon or when a toy vehicle 50 is exiting and/or entering the rotatable track segment or about to enter the rotatable track segment 22 and no other toy vehicles 50 are on the rotatable track segment 22. In the exemplary embodiment as shown in FIGS. 1-2, the track segment 22 includes an arrow 54 (shown in FIG. 1). In this embodiment, the arrow points in a desired direction of rotation. The arrow 54 thus provides direction of where and how the initial force should be exerted.

The rotatable track segment 22 includes a receiving member 60, a generally spiral portion 62, and an exit portion 64. The receiving member 60 may include a scoop 61 that is configured to receive or scoop up one of the toy vehicles 50 from an end or end portion 63 of a feeding segment 66 (shown at least in FIG. 2 with a plurality of toy vehicles 50 placed thereon). The feeding segment 66 is coupled to the receiving track portion 20 such that as the rotatable track segment 22 rotates about the shaft 52 toy vehicles 50 can be queued up to be scooped into the receiving member 60 as the rotatable track segment 22 rotates about shaft 52. The generally spiral portion 62 is rotatably connected or rotatably secured to the shaft 52 by a plurality of connectors 58. As shown, the connectors are of differing lengths, where successive connectors about the shaft 52 are of increasing length from one end of the generally spiral portion 62 to another end of the generally spiral portion 62, until the longest connector is next to the shortest connector thereby defining the spiral configuration of the spiral portion 62 by its securement to the connectors 58 of varying lengths. Also as shown, the longest connector supports two sections of the spiral portion 62. The toy vehicles 50 traverse generally in the direction of arrow D1 as the spiral portion 62 rotates in the direction of arrow 54. That is, rotation of the rotatable track segment 22 about the shaft 52 in the counterclockwise direction causes the toy vehicle or toy vehicles 50 to move or traverse in generally in the direction of arrow D1 or travel clockwise on the track of spiral portion 62 as the spiral portion 62 rotates in a counterclockwise direction. Although the rotatable track segment 22 is rotating in the counterclockwise direction, it is to be understood that in other embodiments the rotatable track segment 22 may rotate in the clockwise direction, and the toy vehicles 50 may traverse within the spiral portion 62 in the counterclockwise direction as well.

In the exemplary embodiment shown in FIGS. 1-2, the toy vehicle or vehicles 50 may travel within the rotatable track segment 22 for about one and one-fourth revolutions of the rotatable track segment 22 before exiting the rotatable track segment 22 through the exit portion 64. Of course, any other configuration having the toy vehicle 50 travel within the rotatable track segment 22 for a greater or fewer number of revolutions is considered to be within the scope of exemplary embodiments of the present invention.

Figure 6:
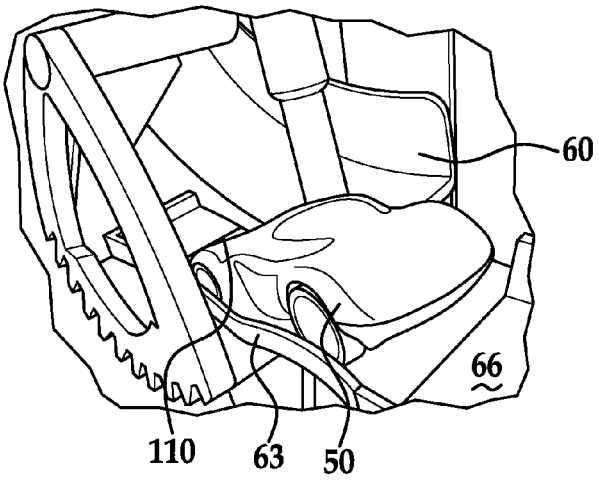
FIGS. 6-8 illustrate a scoop transitioning a toy vehicle from a first track segment to a second track segment according to one non-limiting exemplary embodiment of the present invention.
Figure 7:
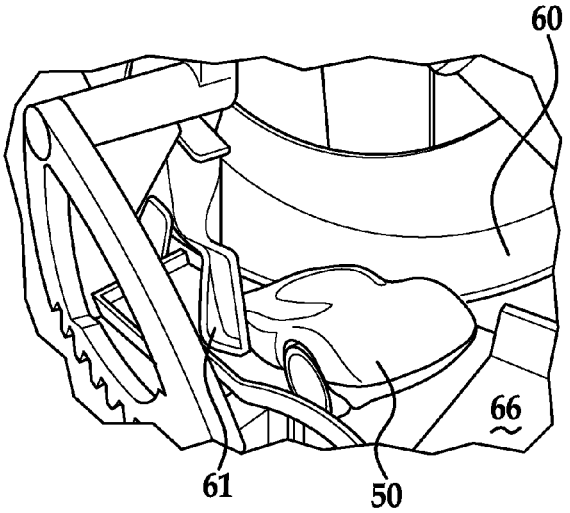
Figure 8:
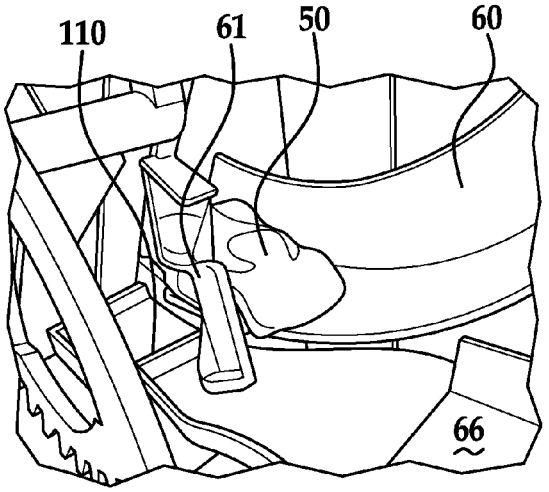

FIG. 6 illustrates a toy vehicle 50 after it has entered the end portion 63 of the feeding segment 66. The toy vehicle 50 rests against a positioning block 110 that locates the toy vehicle 50 in a position on the end portion 63 where the scoop 61 may engage the toy vehicle 50. As illustrated in FIG. 7 and FIG. 8, as the rotatable track segment 22 rotates about the shaft 52, the receiving member 60 approaches the end portion 63 of the feeding portion 66 of the receiving track portion 20, and scoop 61 scoops up one of the toy vehicles 50 located on the feeding portion 66. Once the scoop 61 passes the end portion 63, the position vacated by the previous toy vehicle 50 may be filled by the next toy vehicle 50 as it moves onto the end portion 63 and comes to rest against the positioning block 110. Thus, as long as there are available toy vehicles 50 located within the receiving track portion 20, each time the receiving member 60 approaches the feeding portion 66 or end portion 63 of the feeding portion 66 of the receiving track portion 20, the receiving member 60 scoops up one of the toy vehicles 50. As shown in the attached FIGS. the spiral portion 62, the receiving member 60 and the end 64 are offset from the feeding portion 66 so that the spiral portion 62, receiving member 60 and end 64 can rotate about axis A-A of shaft 52. However, the scoop 61 extends away from receiving member 60 so that it is aligned with the end portion or end 63 of the feeding portion 66 when the rotatable track segment 22 rotates about shaft 52 and receiving member 60 is adjacent to end portion 63. As illustrated, scoop 61 is configured to guide toy vehicles 50 located on end portion 63 into receiving member 60 as the spiral portion 62 and receiving member 60 rotate about axis A-A of shaft 52 and scoop 61 passes over end portion 63. Thereafter and as the spiral portion 62 rotates, the toy vehicles 50 travel from receiving member 60 onto the spiral track of the rotatable track segment 22 and ultimately out end 64.

A support member 65 is configured to support end portion 63 and also allow scoop 61 to pass over the end portion 63 of the feeding portion 66 as the rotatable track segment 22 rotates in the counter clockwise direction. As mentioned above, when scoop 61 passes over the end 63 of feeding portion 66, a toy vehicle 50 located on the end portion 63 is scooped or shifted laterally and/or downwardly from the feeding portion 66 onto the rotatable track segment 22 or the spiral portion 62 via receiving member 60. Once received onto the spiral portion 62, the weight of the toy vehicle(s) 50 within or on the rotatable track segment 22 exert a reactive centrifugal force upon the rotatable track segment 22 or a force that causes rotational movement of the rotatable track segment 22 in the direction of arrow 54, via gravity acting upon the toy vehicle 50 as the toy vehicle(s) 50 traverse(s) within or on the rotatable track segment 22. The force or forces are partially created by movement of the toy vehicle (s) 50 within or on the rotatable track segment 22, and this movement generally sustains or promotes rotation of the rotatable track segment 22. Therefore, rotation of the rotatable track segment 22 is generally self-sustaining as long as there are available toy vehicles 50 queened up on the end portion 63 of the feeding portion 66 such that they can be scooped into the receiving portion 60 of the rotatable track segment 22 as the scoop 61 travels over the end portion 63. In other words, for every rotation of scoop 61 about axis A-A, a new toy vehicle 50 is introduced or scooped into the receiving portion 60 of the rotatable track segment 22, so long as the toy vehicle 50 is located at end portion 63 as the scoop 61 travels over it. In addition and as illustrated, end portion 63 is lower than the opposite end 69 of the feeding portion 66 of the receiving track portion 20 so that the toy vehicles 50 will roll towards end portion 63 and be scooped into receiving portion 60 of the spiral portion 62 as it rotates about axis A-A.

In various embodiments, the rotatable track segment 22 may be configured to allow for the toy vehicle(s) 50 to generally sustain or promote rotation of the rotatable track segment 22 in a specific (e.g., clockwise or counterclockwise) direction. This may accomplished, as seen in the exemplary embodiment, by configuring the rotatable track segment 22 with an increasing radius from its axis of rotation. This feature is readily apparent from the connectors 58 of increasing length that support the rotatable track segment 22 about the shaft 52. The weight of the wheeled toy vehicle 50 imparts a centrifugal force on the rotatable track segment 22 via gravity. In particular, the generally spiral portion 62 of the rotatable track segment 22 begins at the receiving member 60 and ends at end 64, and winds or revolves about a center axis (e.g., at the axis A-A or shaft 52 as seen in FIG. 1) wherein the radius increases from receiving member 60 towards end 64. The generally spiral portion 62 increases in radius as the generally spiral portion 62 winds about the center axis (e.g., the axis A-A), thereby creating the generally spiral shape of the rotatable track segment 22. In the embodiment as shown, the generally spiral portion 62 winds or extends from receiving member 60 to end 64 in a clockwise direction about the axis A-A such that the radius of the track segment increases with respect to axis A-A while in operation it rotates in a counter clockwise direction, however it is to be understood that in various embodiments, the generally spiral portion 62 may wind in the counterclockwise direction and rotate in the clockwise direction as well.

As such and once the spiral portion 62 is imparted with an initial rotational movement, the spiral configuration of track segment 22 and the weight of the toy vehicle 50 causes the spiral portion 62 to continue to rotate in the same direction until the toy vehicle exits from end 64 of the track segment 22. As such, the spiral portion 62 may also be viewed as an elevator transferring a toy vehicle 50 vertically from the feeding segment 66 to the second track portion 70 located below the spiral portion 62. During this rotational movement of spiral portion 62 additional toy vehicles 50 may enter the track segment 22 via operation of the scoop 61 and receiving member 60 and in one embodiment multiple toy vehicles 50 may be received on the track segment 22 as it is rotating.

As mentioned above, the rotatable track segment 22 terminates at the exit portion 64. Referring specifically to FIG. 2, one of the toy vehicles 50 is shown ejected or rolling off the rotatable track segment 22 at the exit portion 64 in a direction that is indicated by the arrow D1, and is received by a linear segment 70 or a non-linear segment of the diverter track set 24. Specifically, one of the linear segments 70 of the diverter track set 24 is positioned relative to the rotatable track segment 22 to receive the toy vehicles 50 as the toy vehicles 50 are ejected or dropped from the rotatable track segment 22. The diverter track set 24 includes a plurality of linear segments 70, a diverter segment 72, and a generally U-shaped or curved segment 74. Of course, any other suitable configuration having fewer track segments or additional track segments is considered to be within the scope of exemplary embodiments of the present invention, and the diverter track set 24 is not limited to the specific configurations illustrated herein.

The toy vehicles 50 traverse within the linear segments 70 of the diverter track set 24 in the general direction D1. In the exemplary embodiment as shown in FIGS. 1-2, the diverter 72 directs the toy vehicles 50 towards the curved segment 74 of the diverter track set 24, however, it is to be understood that in alternative embodiments, the diverter segment 72 may be used to direct the toy vehicles 50 to various other track segments. The curved segment 74 receives the toy vehicles 50 and redirects the toy vehicles 50 in a direction D2. The direction D2 is oriented approximately 220° degrees from the linear segments 70, however it is understood that the curved segment 74 may be oriented with respect to the linear segments 70 in any other configuration as well. The toy vehicles 50 traverse within the curved segment 74 of the diverter track set 24 and into the curved bridge 28.

The curved bridge 28 is movably mounted to the track set 10 so that it can receive toy vehicles 50 from an end portion 76 of the curved segment 74 of the diverter track set 24. The curved bridge 28 is configured for selectively pivoting or swinging in the direction of arrows 75 by movement of the toy vehicles 50 about the curved bridge 28 as they are received from the curved segment 74. The curved bridge 28 includes a generally curved or arcuate profile having a plurality of up and down features for the toy vehicles 50 to traverse within. In the illustrated embodiment, the curved bridge 28 has a curved profile to create a trough T, surrounded by raised portions 77. Of course, any other configuration having multiple troughs is contemplated to be within the scope of exemplary embodiments of the present invention. Also, although a trough T is illustrated, the curved bridge 28 may also be curved in an upwards direction as well, to create a raised portion.

Figure 3:
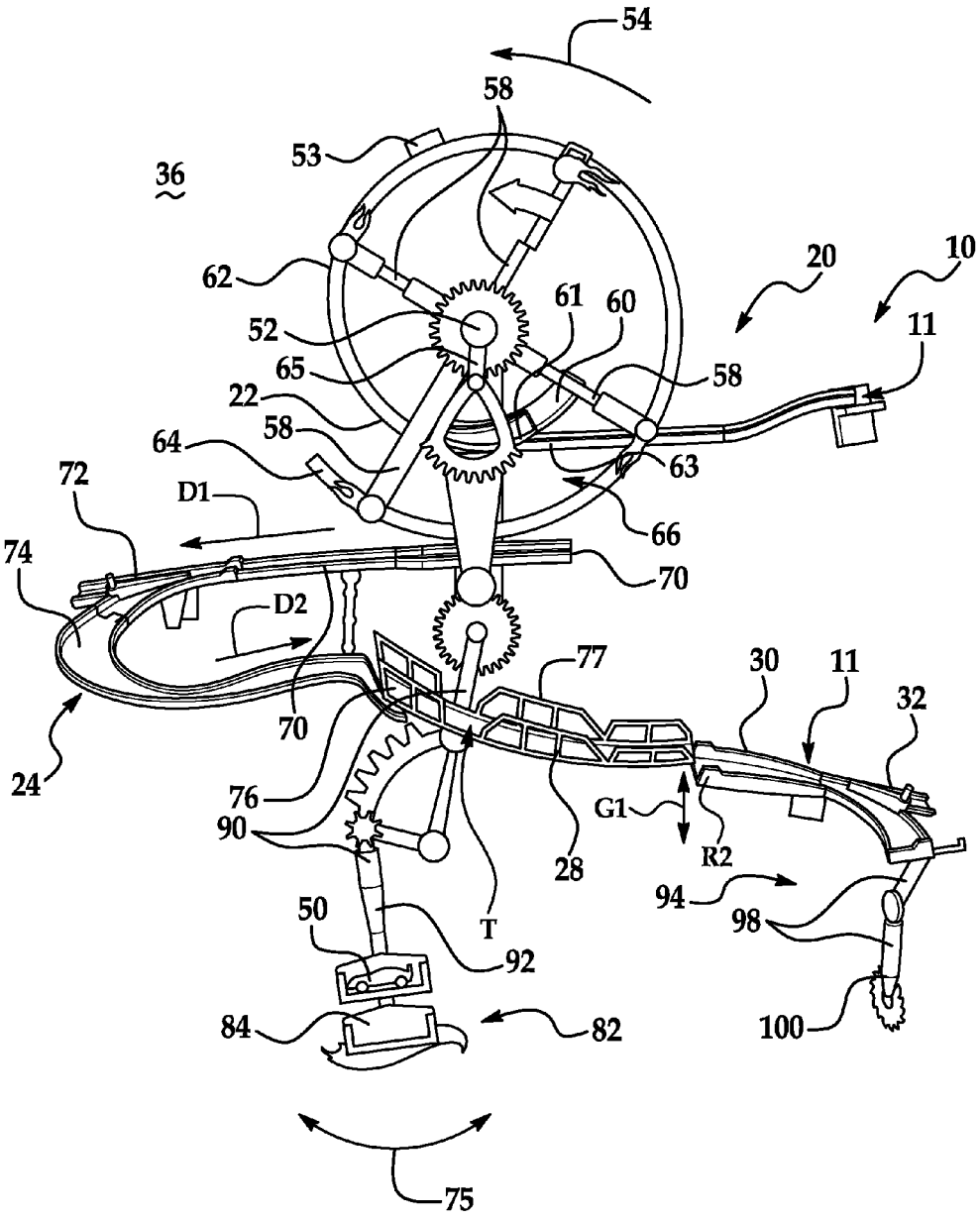
Figure 4:
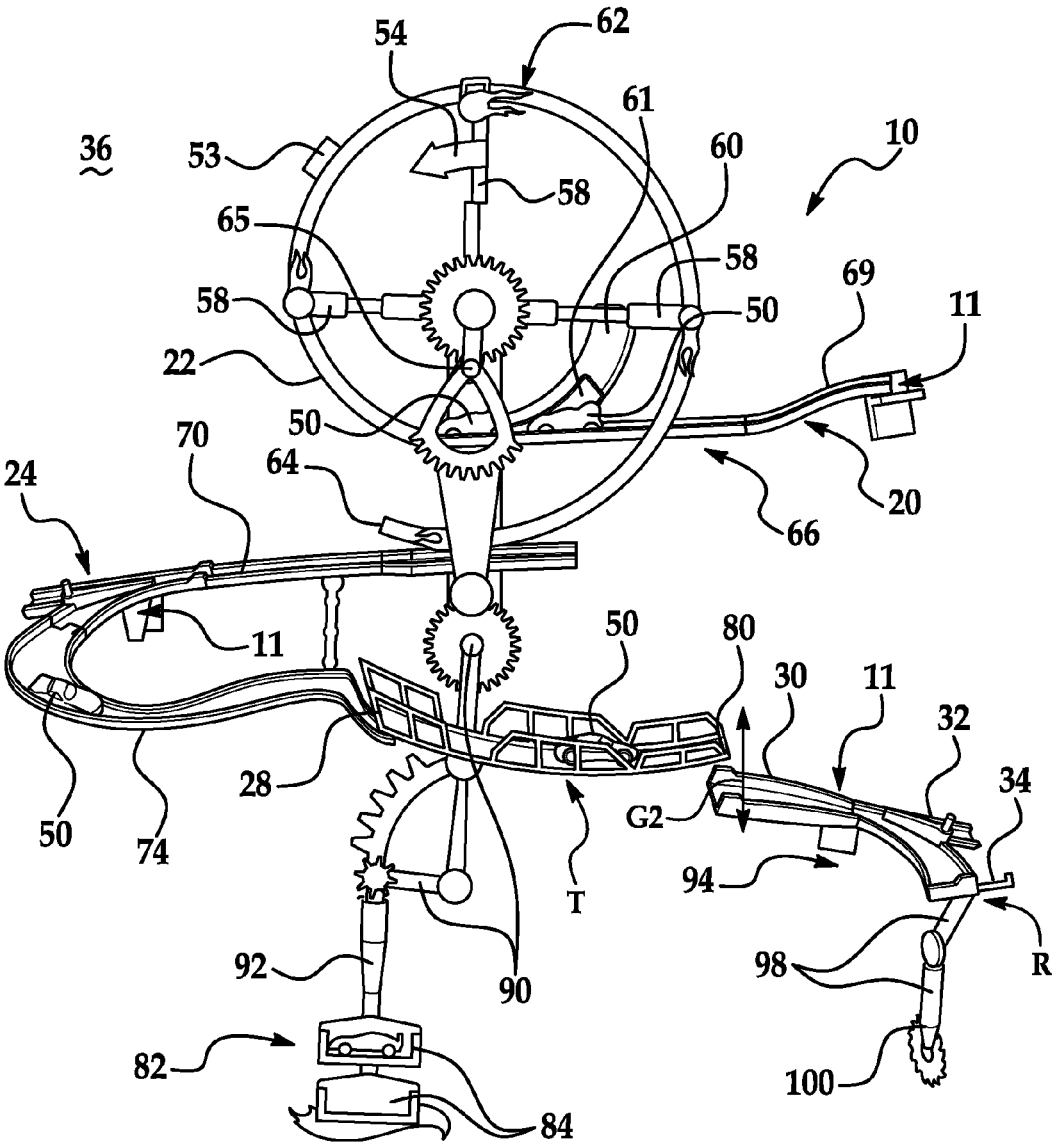
Figure 5:
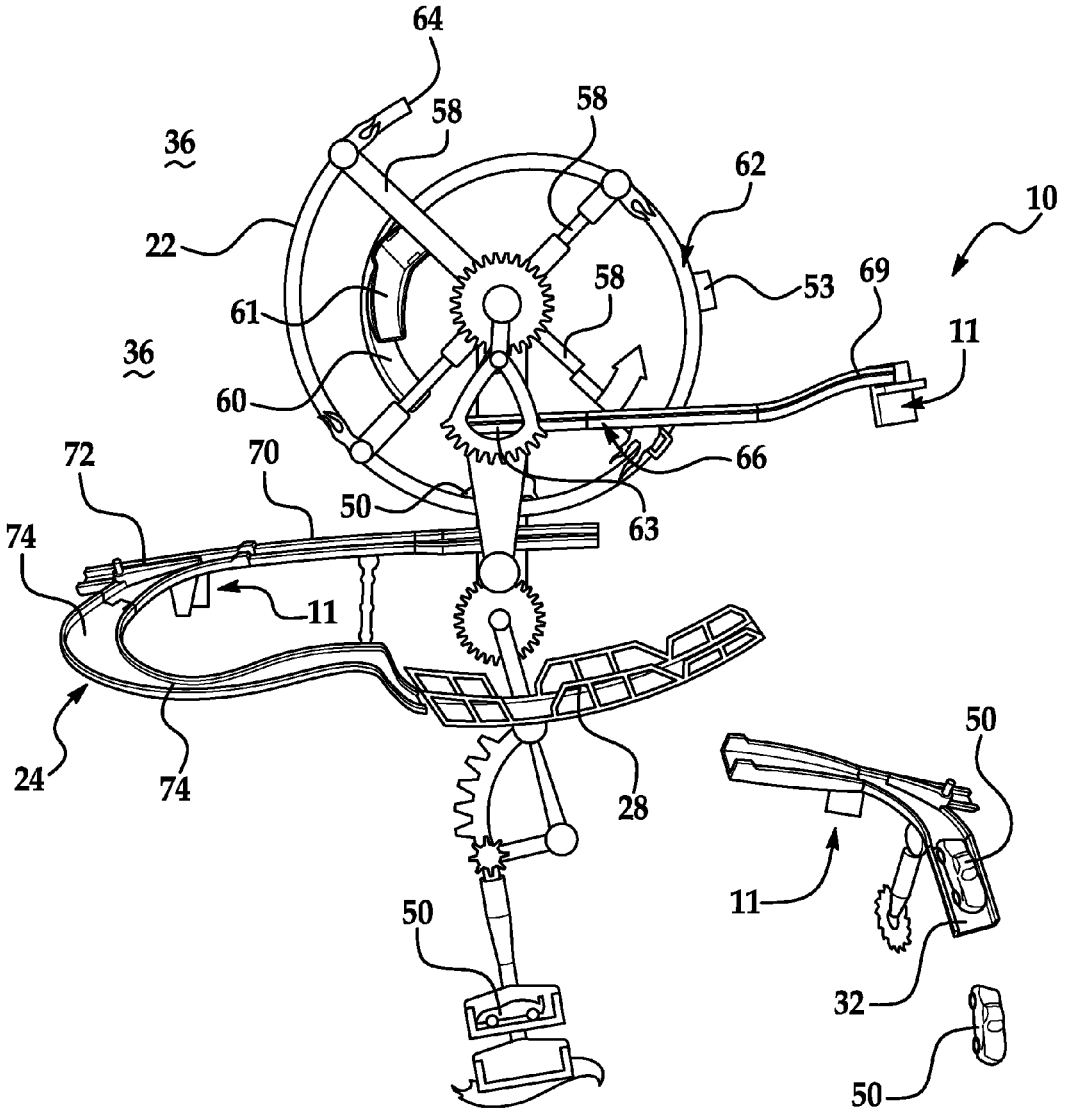

Referring now to FIGS. 3-4, the toy vehicles 50 may traverse towards an end portion 80 of the curved bridge 28 and into the second diverter track segment 30 (which is illustrated in FIG. 3). Alternatively, the toy vehicles 50 may traverse or roll back and forth within the trough T of the curved bridge 28 (which is shown in FIG. 4). In the embodiment as shown in FIG. 3, the curved bridge 28 is positioned such that a first distance or gap G1 is created between the curved bridge 28 and the second diverter track segment 30. The gap G1 is relatively short, thereby allowing the toy vehicles 50 to traverse downwardly into the second diverter track segment 30. In the embodiment as shown in FIG. 4, the curved bridge 28 is positioned such that a second distance or gap G2 exists between the curved bridge 28 and the second diverter track segment 30, where first gap G1 is less than the second gap G2.

Depending on the specific motion dynamics, the curved bridge 28 may swing such that the end portion 80 is positioned adjacent to the second diverter track segment 30 to receive one of the toy vehicles 50 (shown in FIG. 3). In one approach, one of the toy vehicles 50 (e.g., illustrated as R1 in FIG. 3) may impact or collide with another one of the toy vehicles 50 (e.g., illustrated as R2 in FIG. 3), thereby causing the toy vehicle R2 to traverse onto the second diverter track segment 30. Alternatively, instead of colliding the toy vehicle R1 with the toy vehicle R2, movement of the toy vehicle R2 along the curved bridge 28 may cause the curved bridge 28 to pivot about the end portion 76 of the diverter track set 24 as well, where swinging of the curved bridge 28 about the end portion 76 may cause the toy vehicle R2 to travel into the second diverter track segment 30.

In a basic embodiment, the curved bridge 28 is connected to a member 90. The member 90 is attached to the remainder of the system via a pivot point at one end of the member 90. Thus, the curved bridge 28 and the member 90 rotate about the fixed pivot point. In some embodiments, the curved bridge 28 is attached to the member 90 at a point that is offset from the center of the length of the curved bridge 28. For example, the curved bridge 28 may be attached to the member 90 at a point offset from the bottom of the trough T. The offset adds complexity to the rotation of the curved bridge 28 about the fixed pivot point. Additional complexity to the motion occurs with the introduction of motion from a moving toy vehicle 50 traversing the curved bridge 28.

In an intermediate embodiment, the member 90 extends beyond the curved bridge. Additional weight may be attached to the member 90. In some embodiments, the member 90 has one or more appendages upon which the additional weight may be attached. Thus, the additional weight may be attached offset from a main line of the member 90. For example, an end member 92 is illustrated as attached to an appendage and offset from the main line of the member 90.

In a complex embodiment, the additional weight is in the form of a free-swinging pendulum 82. As illustrated, the swinging pendulum 82 includes a plurality of baskets 84 that are configured for receiving a mass, such as one or more of the toy vehicles 50. The specific motion of the curved bridge 28 (e.g., the swinging of the curved bridge 28) may depend on at least the movement of the toy vehicles 50 along the curved bridge 28, the number of toy vehicles 50 presently located on the curved bridge 28, the free-swinging pendulum 82 that is attached to the curved bridge 28, and their respective points of attachment/pivot with respect to each other. The presence of a mass in either or both the baskets 84 also affects the dynamics of the curved bridge 28.

The second diverter track segment 30 may be attached to the drawbridge track segment 32, and directs the toy vehicles 50 towards the drawbridge track segment 32. The drawbridge track segment 32 includes a normally raised bridge portion R. However, turning now to FIG. 5, as one of the toy vehicles 50 travels onto the drawbridge track segment 32 and through the normally raised bridge portion R, the weight of the toy vehicle 50 exerted upon the normally raised bridge portion actuates the normally raised bridge portion into a lowered position.

Turning back to FIGS. 2-3, a second pendulum 94 is attached to the drawbridge track segment 32. The second pendulum 94 includes a plurality of members 98 that are pivotably connected to one another, and a restoring weight 100. The restoring weight 100 is a free-swinging weight that causes the members 98 to pivot relative to one another. The restoring weight 100 is raised when the drawbridge track segment 32 is lowered (shown in FIG. 5), and is lowered when the drawbridge track segment 32 is raised. The swinging of the restoring weight 100 is used to raise the drawbridge track segment 32 from the lowered position (shown in FIG. 5) back to the normally raised configuration as shown in FIG. 3-4.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A track set, comprising:

a first track portion configured for receiving at least one toy vehicle, the at least one toy vehicle configured to traverse along the first track portion in a first direction; and a rotatable track portion that includes a receiving member and a generally spiral portion, the rotatable track portion selectively rotatable about an axis generally perpendicular to the first direction, wherein the receiving member is selectively positioned to receive the at least one toy vehicle from an end of a feeding portion from the first track portion as the rotatable track portion rotates about the axis, wherein the receiving member further comprises a scoop configured to scoop the at least one toy vehicle from the end of the feeding portion and shift the at least one toy vehicle laterally into the receiving member as the rotatable track portion rotates about the axis, wherein the scoop is aligned with and passes over the end of the feeding portion as the rotatable track rotates about the axis, and wherein movement of the at least one toy vehicle within the spiral portion imparts a force on the rotatable track portion in order to assist in the rotation of the rotatable track portion about the axis.

2. The track set of claim 1, wherein the rotatable track portion includes an exit portion, wherein the rotatable track portion terminates at the exit portion, and wherein the rotatable track portion is configured to allow the at least one toy vehicle to exit therefrom via the exit portion.

3. The track set of claim 1, wherein the rotatable track portion transfers the at least one toy vehicle from the feeding portion to a second track portion separated from and located below the rotatable track portion, the second track portion being aligned with the rotatable track portion and located below the rotatable track portion wherein at least a portion of the second track portion extends generally in the first direction.

4. The track set of claim 3, wherein the generally spiral portion of the rotatable track portion extends from the receiving member and terminates at an end portion, wherein a radius of the generally spiral portion from the axis increases in a direction from the receiving member to the end portion.

5. The track set of claim 4, wherein the track set is mounted to a vertical wall by a plurality of wall mounts.

6. The track set of claim 1, wherein the generally spiral portion of the rotatable track portion extends from the receiving member and terminates at an end portion, wherein a radius of the generally spiral portion from the axis increases in a direction from the receiving member to the end portion.

7. A track set comprising:

a first track portion configured for receiving at least one toy vehicle, the at least one toy vehicle configured to traverse along the first track portion in a first direction; and a rotatable track portion that includes a receiving member, a generally spiral portion, and an exit portion, the rotatable track portion selectively rotatable about an axis generally perpendicular to the first direction, wherein the receiving member is selectively positioned to receive the at least one toy vehicle from an end of the first track portion, wherein the first track portion is offset from the rotatable track portion and wherein the receiving member comprises a scoop configured to scoop the at least one toy vehicle and shift the at least one toy vehicle laterally from the first track portion to the rotatable track portion as the rotatable track portion rotates about the axis, and wherein movement of the at least one toy vehicle within the spiral portion imparts a force on the rotatable track portion in order to assist in the rotation of the rotatable track portion about the axis, and the rotatable track portion terminates at the exit portion; and a second track portion that is positioned to receive the at least one toy vehicle from the exit portion of the rotatable track portion, the rotatable track portion configured to allow the at least one toy vehicle to exit therefrom via the exit portion to the second track portion.

8. The track set of claim 7, wherein the second track portion is aligned with and located below the generally spiral portion and wherein at least a portion of the second track portion extends generally in the first direction.

9. The track set of claim 8, wherein the track set further comprises a generally curved bridge that is moveably mounted to the track set and receives the at least one toy vehicle from the second track portion.

10. The track set of claim 7, wherein the generally spiral portion is rotatably secured to a shaft via a plurality of connectors each having different lengths.

11. The track set of claim 10, wherein the plurality of connectors are of increasing length from one end of the generally spiral portion to another end of the generally spiral portion.

12. The track set of claim 7, wherein the rotatable track portion is offset from the first track portion and the generally spiral portion of the rotatable track portion extends from the receiving member and terminates at the exit portion, wherein a radius of the generally spiral portion from the axis increases in a direction from the receiving member to the exit portion and wherein the generally spiral portion is rotatably secured to a shaft via a plurality of connectors each having differing lengths, wherein the plurality of connectors are of increasing length from one end of the generally spiral portion to another end of the generally spiral portion until a longest connector is next to a shortest connector of the plurality of connectors and wherein the longest connector supports two sections of the generally spiral portion.

13. The track set of claim 7, wherein the track set is mounted to a vertical wall by a plurality of wall mounts.

* * * * *